US008337155B2

(12) United States Patent
Yoo et al.

(10) Patent No.: US 8,337,155 B2
(45) Date of Patent: Dec. 25, 2012

(54) FAN ASSEMBLY HAVING REDUCED VIBRATION

(75) Inventors: Myung-Keun Yoo, Seoul (KR); Hyoun-Jeong Shin, Incheon (KR)

(73) Assignee: LG Electronics Inc., Seoul (KR)

( * ) Notice: Subject to any disclaimer, the term of this patent is extended or adjusted under 35 U.S.C. 154(b) by 928 days.

(21) Appl. No.: 12/327,039

(22) Filed: Dec. 3, 2008

(65) Prior Publication Data

US 2009/0169387 A1 Jul. 2, 2009

(30) Foreign Application Priority Data

Dec. 28, 2007 (KR) ..... 10-2007-0140932

(51) Int. Cl.
*F01D 25/24* (2006.01)

(52) U.S. Cl. ..... 415/214.1; 415/121.2; 416/247 R; 361/679.51; 361/679.48

(58) Field of Classification Search ..... 415/119, 415/213.1, 196
See application file for complete search history.

(56) References Cited

U.S. PATENT DOCUMENTS

| | | | | |
|---|---|---|---|---|
| 3,714,795 | A * | 2/1973 | Fowell et al. | 62/508 |
| 4,036,292 | A * | 7/1977 | Hine, Jr. | 165/122 |
| 5,713,413 | A * | 2/1998 | Osakabe et al. | 165/104.33 |
| 2002/0088237 | A1* | 7/2002 | Rudick et al. | 62/6 |
| 2004/0033138 | A1 | 2/2004 | Jung et al. | |
| 2004/0101409 | A1 | 5/2004 | Jung et al. | |
| 2005/0053493 | A1 | 3/2005 | Chung et al. | |
| 2005/0132730 | A1 | 6/2005 | Lim et al. | |
| 2005/0160760 | A1 | 7/2005 | Chae et al. | |
| 2005/0162831 | A1* | 7/2005 | Shum et al. | 361/695 |
| 2007/0002536 | A1* | 1/2007 | Hall et al. | 361/695 |
| 2007/0003419 | A1 | 1/2007 | Wu et al. | |
| 2007/0014678 | A1* | 1/2007 | Seo | 417/423.13 |
| 2007/0237625 | A1* | 10/2007 | Liang | 415/119 |
| 2008/0137295 | A1* | 6/2008 | Chen | 361/695 |

FOREIGN PATENT DOCUMENTS

| | | | |
|---|---|---|---|
| CN | 2472459 | Y | 1/2002 |
| CN | 1940307 | A | 4/2007 |
| CN | 101022196 | A | 8/2007 |
| EP | 0 408 221 | B1 | 1/1991 |
| KR | 2004013819 | A * | 2/2004 |

OTHER PUBLICATIONS

U.S. Appl. No. 12/337,078 to Yoo et al., filed Dec. 17, 2008.
U.S. Appl. No. 12/337,110 to Yoo et al., filed Dec. 17, 2008.
Chinese Office Action dated May 19, 2010 issued in Application No. 200810190639.5.

* cited by examiner

*Primary Examiner* — Ajay K Arora
(74) *Attorney, Agent, or Firm* — KED & Associates, LLP

(57) ABSTRACT

A fan assembly is provided. The fan assembly includes a fan, and a shroud having a motor mounting portion on which a fan motor of the fan is mounted. One or more coupling units are provided at a lower side of the shroud, and on a planar surface of an apparatus, and one or more vibration preventing members are interposed between the coupling units. Because the fan and the motor mounted thereto cause vibration and noise to the fan assembly in the apparatus, the vibration preventing members are interposed between the coupling units of the shroud and the apparatus to reduce the amount of vibration and noise transmitted from the fan and the motor to the apparatus.

17 Claims, 9 Drawing Sheets

FAN ASSEMBLY HAVING REDUCED VIBRATION

CROSS-REFERENCE TO RELATED APPLICATIONS

This application claims priority under 35 U.S.C. §119 to Korean Application No. 10-2007-0140932 filed in Korea on Dec. 28, 2007, the entirety of which is hereby incorporated by reference.

BACKGROUND OF THE INVENTION

1. Field of the Invention

The present invention relates to a fan assembly, and more particularly, to a fan assembly to dissipate heat that may be included in a machine room of a refrigerator in which a compressor, a condenser, and the fan are also provided.

2. Description of the Background Art

Generally, a refrigerator serves to store food with a low temperature in a frozen state or a cooled state according to the kind of food to be stored.

Cool air is generated and is continuously supplied into the refrigerator as a refrigerant repeatedly performs a heat exchange operation, e.g., compression-condensation-expansion-evaporation. The cool air is uniformly transmitted through the inside of the refrigerator by convection, and serves to maintain food inside the refrigerator at a desired temperature.

A refrigerating cycle device is provided at one side of the refrigerator separately from other storage spaces such as a cooling chamber and a freezing chamber. More particularly, compression and condensation processes are performed by a compressor and a condenser disposed at a machine room provided at a lower side of a rear surface of the refrigerator.

During the compression and condensation processes, heat must be dissipated. To this end, a fan and a motor configured to drive the fan are provided at the machine room to assist in dissipating the heat generated from the compression and condensation processes.

However, when the motor is actuated and the fan is rotated within a shroud, vibration and noise are generated in the machine room. As a result, a user may be inconvenienced. Accordingly, a fan assembly configured to reduce vibration and noise generated from the motor and fan is required.

SUMMARY OF THE INVENTION

Therefore, the present invention provides a fan assembly configured to reduce vibration and noise generated from a fan and a motor, and to efficiently dissipate heat, such as heat generated by a condenser and a compressor inside a machine room of a refrigerator.

To achieve these and other features, and in accordance with the present invention, as embodied and broadly described herein, there is provided in a non-limiting embodiment, a fan assembly including a fan, a shroud comprising a motor mounting portion on which a fan motor of the fan is mounted, one or more coupling units provided at a lower side of the shroud, which couple the shroud to a planar surface of an apparatus, and one or more vibration preventing members interposed between the coupling units and the shroud. In some embodiments, the apparatus is a machine room of a refrigerator provided with a compressor and a condenser.

A non-limiting feature of the present invention includes providing coupling units that include receiving portions downwardly opened and disposed at lower sides of the shroud, and configured to receive the vibration preventing members, and shroud coupling portions upwardly protruding from the planar surface of the apparatus adjacent the receiving portions.

In embodiments, the vibration preventing members engage the receiving portions, and are coupled to the shroud coupling portions in a side direction.

In embodiments, the receiving portions are configured such that each inlet width thereof is narrower than each outer diameter of the vibration preventing members.

Another feature of the present invention provides fitting grooves provided on outer side surfaces of the vibration preventing members engaging the receiving portions.

In embodiments, coupling holes are provided at the vibration preventing members and the shroud coupling portions receive coupling members configured to couple the vibration preventing members and the shroud coupling portions.

In embodiments, the shroud is configured to fit to a shape of a longitudinal section of the apparatus, and a hermetic member is further provided on an outer edge of the shroud contacting an inner surface of the apparatus.

In still other embodiments, a lower end of the shroud is coupled to the planar surface of the apparatus with a space provided therebetween.

In yet another non-limiting embodiment, a fan assembly is provided and includes a fan, a shroud comprising a motor mounting portion on which a fan motor of the fan is mounted, and a shroud ring disposed around the fan, a frame having the shroud mounted thereto, and coupled to an apparatus, one or more coupling units provided at the shroud and the frame, and configured to mount the shroud to the frame, and one or more vibration preventing members interposed between the coupling units. In embodiments, the apparatus is a machine room of a refrigerator provided with a compressor and a condenser.

In embodiments, the frame may be provided with an opening configured to receive the shroud ring when the shroud is mounted thereto.

In further embodiments, the coupling units include protrusions outwardly protruding from an outer circumference of the shroud ring in a radial direction, receiving portions provided at each end of the protrusions so as to be opened in the radial direction, and shroud coupling portions provided at the frame adjacent the receiving portions.

In embodiments, the vibration preventing members engage the receiving portions, and are coupled to the frame in a side direction.

Further, the present invention contemplates at least two coupling units are provided around the shroud ring at uniformly spaced intervals.

In still other embodiments, the receiving portions are provided so that each inlet width thereof is narrower than each outer diameter of the vibration preventing members.

In embodiments, fitting grooves are provided on outer side surfaces of the vibration preventing members and engage the receiving portions.

According to another feature of the non-limiting embodiments, the frame is configured to fit to a shape of a longitudinal section of the apparatus, and a hermetic member is further provided on at least an outer edge of the frame contacting an inner surface of the apparatus.

In embodiments, the frame is integrally provided with the apparatus.

In alternative embodiments, the frame is fixedly coupled to frame coupling portions provided on a bottom surface of the apparatus.

In embodiments, the frame coupling portions protrude from a bottom surface of the apparatus, and have angled end portions, and engage insertion portions provided at a lower side of the frame.

In still further embodiments, the end portions of the frame coupling portions are elastically deformable.

While the present invention is described herein as being used with refrigeration systems, it is not limited to such applications. In this regard, the present invention further contemplates use of the fan assembly in, but not limited to computer systems, HVAC systems, automotive applications, alone, and other known cooling and heating systems.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the present invention, are incorporated in and constitute a part of this specification. The drawings illustrate non-limiting embodiments of the present invention and together with the detailed description and appended claims serve to explain the principles of the present invention.

In the drawings.

DETAILED DESCRIPTION OF THE INVENTION

Reference will now be made in detail to the non-limiting embodiments of the present invention, examples of which are illustrated in the accompanying drawings. Although some embodiments are illustrated herein, it should be understood that numerous other modifications and embodiments can be devised by those skilled in the art that will fall within the spirit and scope of the principles of the present invention.

A fan assembly according to a first non-limiting embodiment of the present invention will now be explained in detail with reference to the attached drawings.

Figure 1:
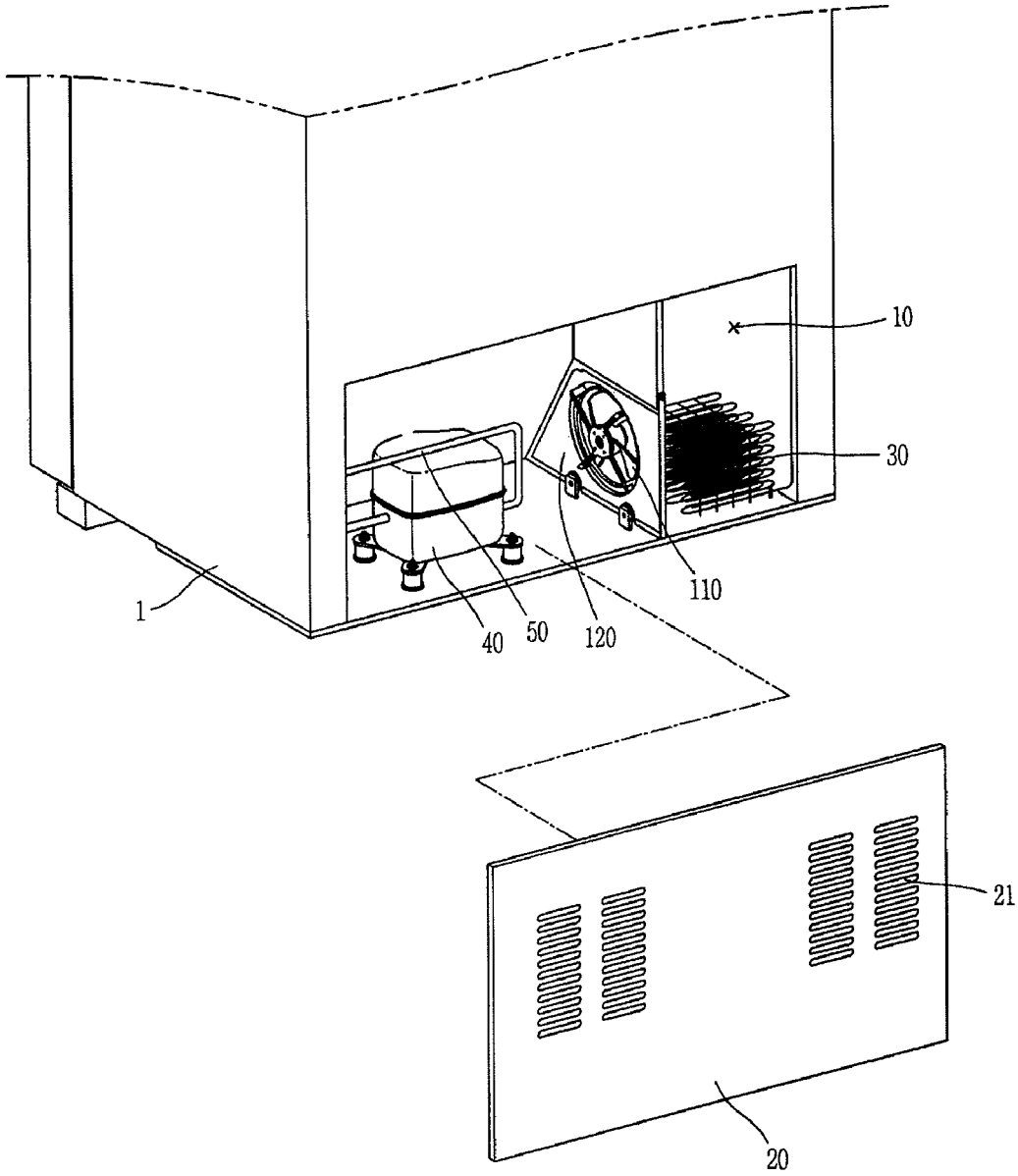
FIG. 1 shows an inside of a machine room in a refrigerator according to a non-limiting embodiment of the present invention.

FIG. 1 shows inside of a machine room in a refrigerator 1 according to the first embodiment of the present invention.

Referring to FIG. 1, the machine room 10 of the refrigerator 1 is disposed at a lower side of a rear surface of the refrigerator 1, and includes a compressor 40, a condenser 30, a refrigerant pipe 50, a fan 110 to dissipate heat from the compressor 40 and the condenser 30, and a shroud 120 having the fan 110 and a motor 130 mounted thereto.

The interior of the machine room 10 is shielded by a machine room cover 20.

The compressor 40 compresses a refrigerant into a gaseous refrigerant in high temperature and high pressure, and directs the gaseous refrigerant to the condenser 30.

In order to prevent vibration and noise generated by the compressor 40 during a heat exchange operation, vibration preventing members may be provided on an installation surface of the compressor 40.

The condenser 30 condenses the gaseous refrigerant in high temperature and high pressure from the compressor 40 to a liquid refrigerant in low temperature and high pressure.

The machine room cover 20 shields the interior of the machine room 10 and is provided with air passing holes 21 through which external air is introduced into and discharged out of the refrigerator.

The fan 110 may be configured as an axial fan linearly aligned with the compressor 40 and the condenser 30 such that heat can be effectively dissipated from the machine room 10. In this regard, the fan 110 is mounted to the shroud 120 and provided in the machine room 10 between the compressor 40 and the condenser 30. However, the shroud 120 may be provided at an end side of the machine room 10 adjacent the condenser 30 in FIG. 1.

The fan 110 and the shroud 120 will now be explained in detail with reference to FIGS. 2 to 4.

Figure 2:
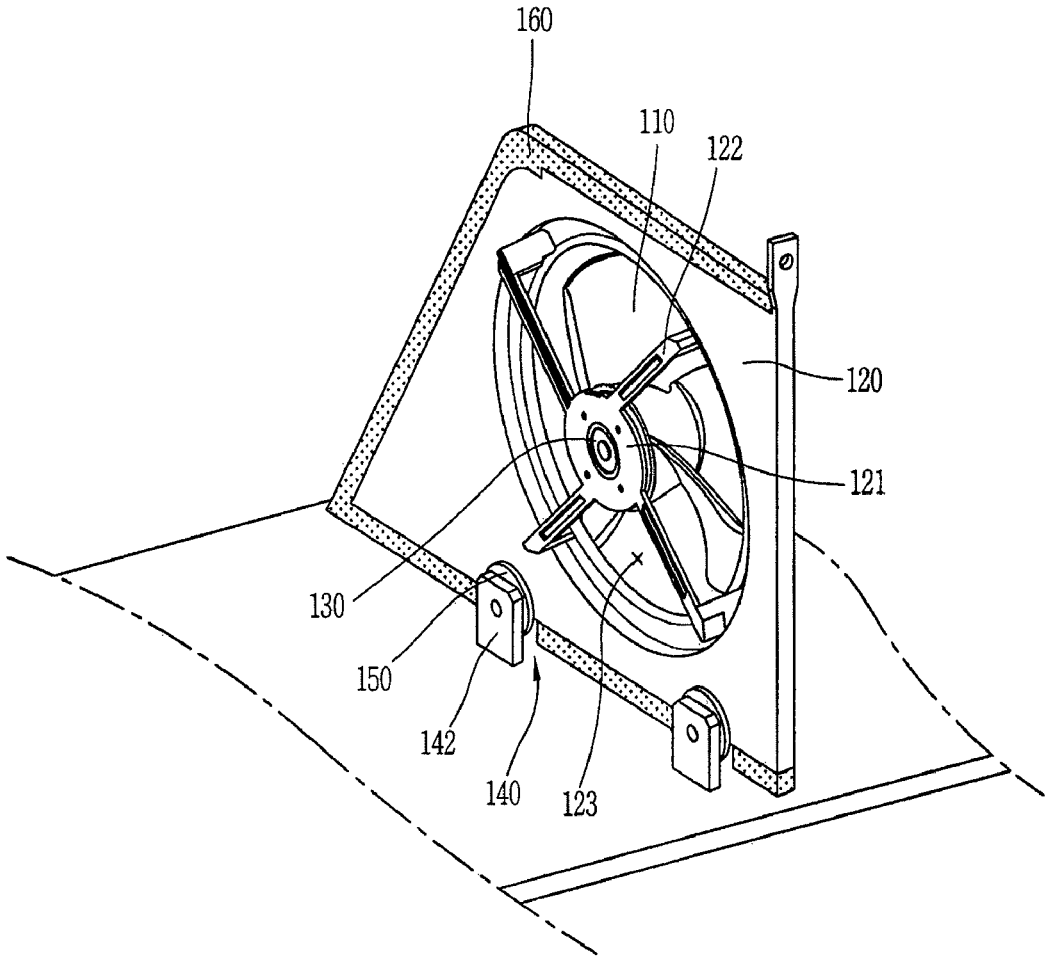
FIG. 2 is a rear perspective view of a fan coupled to a shroud according to a non-limiting embodiment of the present invention.

FIG. 2 is a rear perspective view of a surface of an apparatus, which shows the fan 110 coupled to the shroud 120. FIG. 3 is another perspective of the apparatus showing a coupling unit coupling the shroud 120 to the surface 10 in the apparatus according to a non-limiting embodiment of the present invention. FIG. 4 is a front view of a receiving portion and a vibration preventing member of the coupling assembly of FIG. 3.

Referring to FIG. 2, the fan 110 having a motor 130 coupled thereto is mounted to the shroud 120 for support, and the shroud 120 is coupled to a bottom surface of the apparatus by coupling units 140. Vibration preventing members 150 are disposed at the coupling units 140.

In order to reduce the amount of space occupied by the fan 110 and the motor 130 when coupled in an axial direction, the motor 130 may be configured as an outer rotor type motor. According to the outer rotor type motor, a stator is disposed inside a rotor, and the rotor is disposed within the fan 110.

The motor 130 is mounted to and supported by the shroud 120. The shroud 120 includes an opening 123 through which air generated by the fan 110 passes.

The motor 130 is mounted to a motor mounting portion 121 disposed at a central part of the opening 123, and the motor mounting portion 121 is supported by four motor supporting portions 122 extending therefrom; however, the present invention contemplates providing fewer or more motor supporting portions to support the motor mounting portion and the motor mounted thereto.

The opening 123 is configured with a diameter so as to be adjacent with an outer radial edge of the fan 110. The diameter of the opening 123 is larger than a diameter of the radial edge of the fan 110 such that the fan 110 may be disposed within the diameter of the opening 123.

An end portion of the opening 123 may be provided such that a concave surface of the end portion extends radially along the opening 123 in a downstream direction of the fan 110.

Accordingly, air flowing in a downstream direction of the fan 110 is prevented from leaking in a radial direction of the fan 110, thereby preventing noise caused by air leakage.

Figure 3:
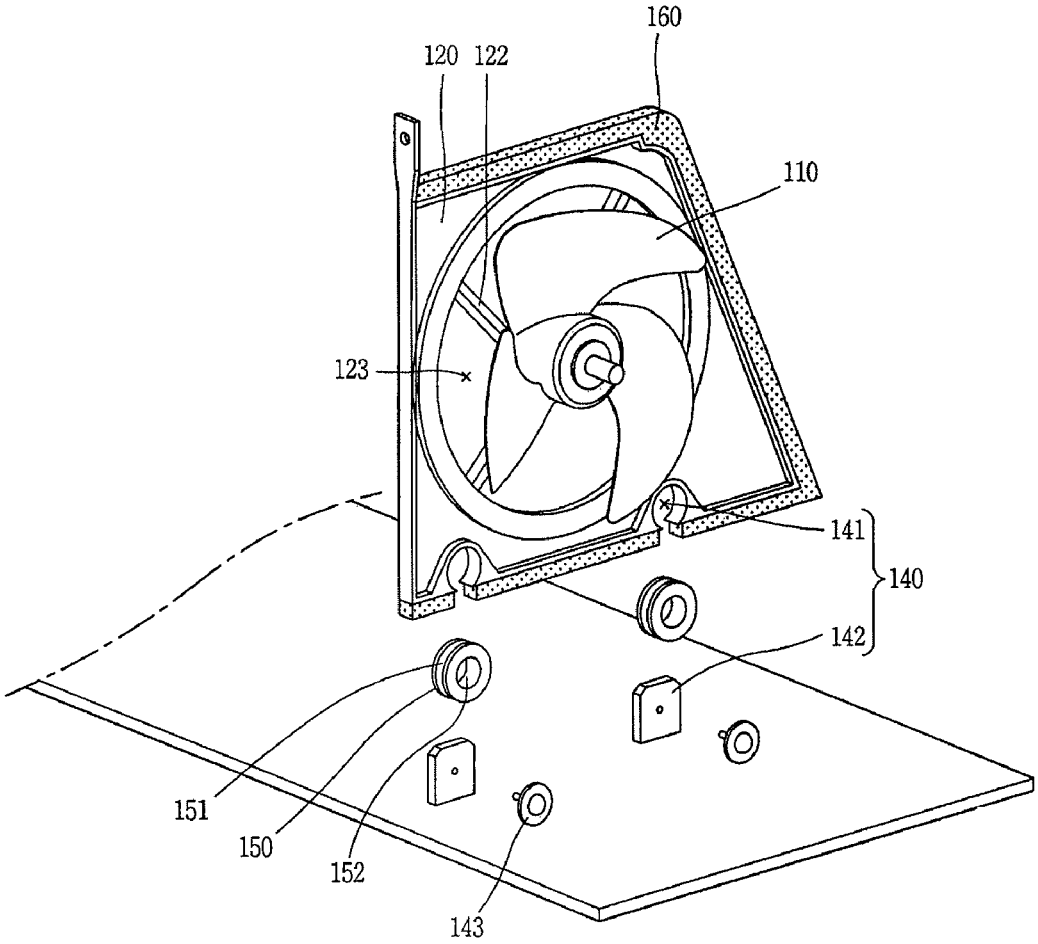
FIG. 3 is a perspective view showing a coupling assembly coupling the shroud to a surface of an apparatus according to a non-limiting embodiment of the present invention.

Referring to FIG. 3, the coupling units 140 include receiving portions 141 disposed at lower sides of the shroud 120, and shroud coupling portions 142 that protrude from a bottom surface of the machine room 10 in correspondence to the receiving portions 141.

The receiving portions 141 are provided at lower ends of the shroud 120, and are downwardly opened and may be configured as arcuate slots, or any other suitable shape to couple with a complimentary structure.

In order to stably couple the shroud 120 to the machine room 10, two receiving portions 141 are provided; however fewer or more receiving portions may be provided for additional stability of the shroud and related components.

The shroud coupling portions 142 protrude from the bottom surface of the apparatus in correspondence to the receiving portions 141. The shroud coupling portions 142 may be rectangular in shape (although other suitable shapes are contemplated by the present invention). Coupling holes (not labeled) may be provided at a central part of the shroud coupling portions 142. The coupling holes are linearly aligned along a central axis in the axial direction of the receiving portion 141, the shroud coupling portion 142, and the coupling member 143.

Vibration preventing members 150 are disposed between the coupling units 140. The vibration preventing members 150 are further disposed within the receiving portions 141, and are coupled to the shroud coupling portions 142 in a side direction by coupling members 143.

The vibration preventing members 150 are disposed between the receiving portions 141 and the shroud coupling portions 142, such that direct contact between the receiving portions 141 and the shroud coupling portions 142 is prevented. Accordingly, vibration and noise generated from the fan 110 and the shroud 120 are prevented from being transmitted to the apparatus via the shroud coupling portions 142, and absorbed by the vibration preventing members 150.

In order to allow the fan 110 to be easily replaced, repaired, etc. the coupling members 143 may be configured as bolts or pins that can be easily detachably mounted, or any other suitable removable fastener.

The vibration preventing members 150 are cylindrical in shape, although other suitable shapes are contemplated by the present invention, and an aperture 152 extends through a central part therethrough creating an inner diameter (d2) and an outer diameter (d1). The vibration preventing members 150 may be made of rubber or any suitable material known to absorb and dampen vibrations and/or noise. Fitting grooves 151 are provided along a central part of the outer diameter (d1) in a circumferential direction such that the fitting grooves 151 mate with receiving portions 141 at an inner arcuate surface of the arcuate slot. The fitting grooves 151 mated with the receiving portions 141 prevent the vibration preventing members 150 from moving in a thickness direction.

Figure 4:
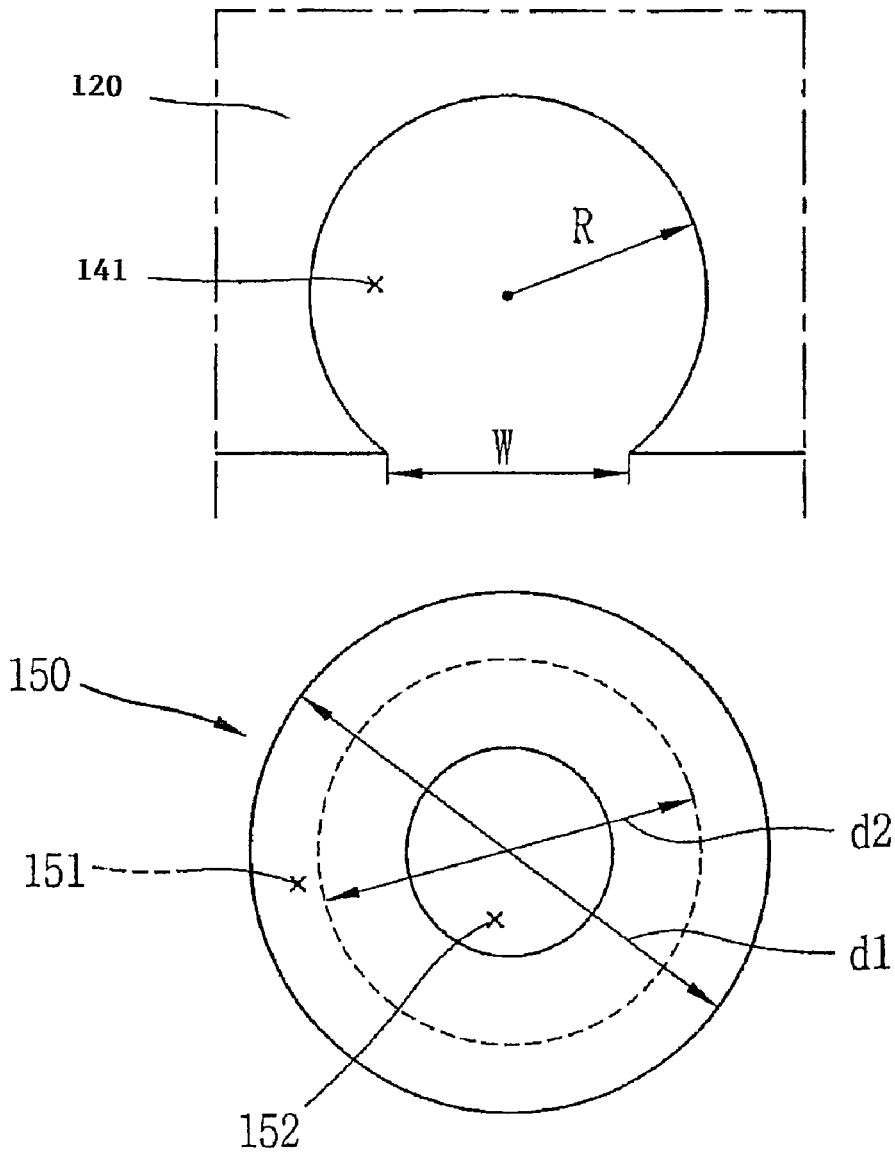
FIG. 4 is a front side view of a receiving portion and a vibration preventing member of FIG. 3 according to a non-limiting embodiment of the present invention.

Referring to FIG. 4, each of the receiving portions 141 is provided such that an inlet width (W) thereof may be narrower than each outer diameter (d1) of the vibration preventing members 150. The inlet width is configured to receive the vibration preventing member 150 via the fitting groove 151.

A curvature radius (R) of the inner arcuate surface of each of the receiving portions 141 is configured to be smaller than ½ of each outer diameter (d1) of the vibration preventing members 150, and is configured to be equal to or smaller than ½ of the diameter (d2) of the fitting groove 151.

Accordingly, the vibration preventing members 150 are prevented from rotating along the inner arcuate surface of the receiving portions 141.

An engagement between an outer surface of the shroud 120 and the bottom surface of the apparatus will now be explained in detail with reference to FIG. 5.

Figure 5:
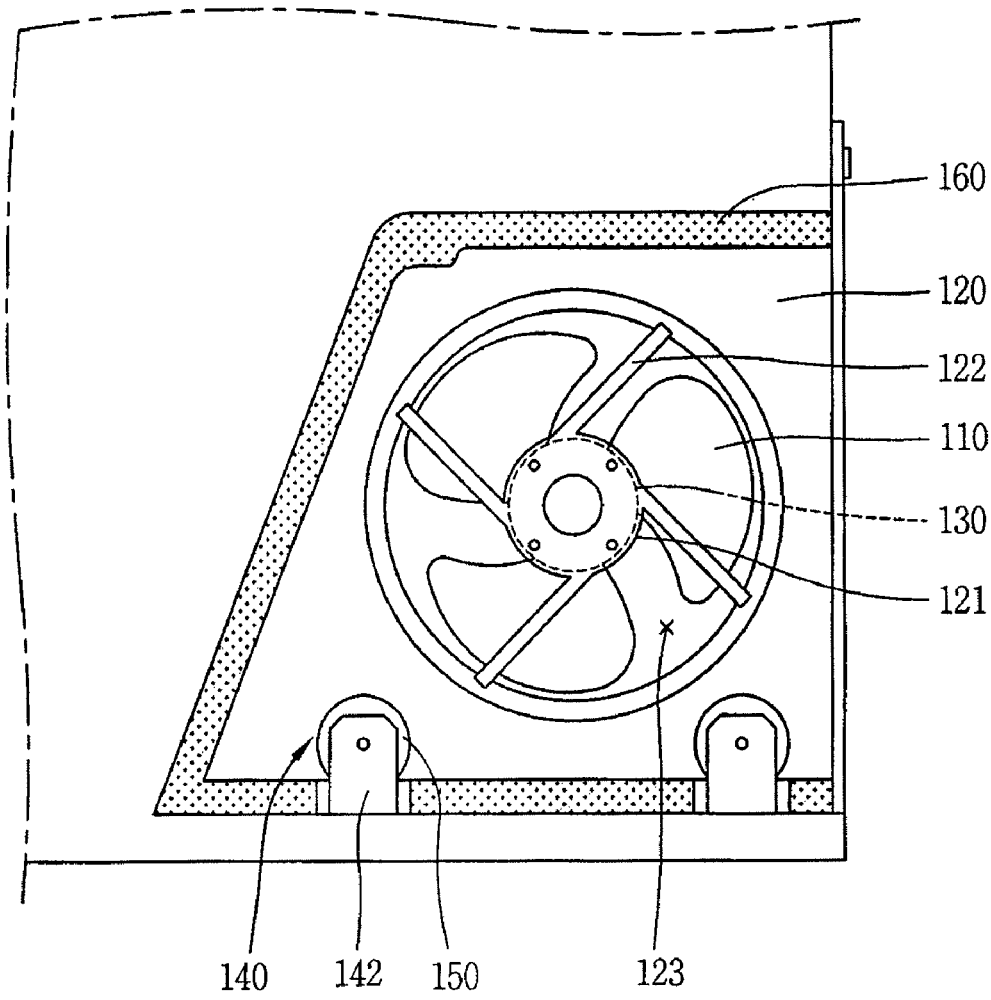
FIG. 5 is a longitudinal section view showing the fan, shroud, and coupling assembly according to a non-limiting embodiment of the present invention.

FIG. 5 is a longitudinal section view of the shroud and the coupling assembly in the apparatus according to the first non-limiting embodiment of the present invention;

Referring to FIG. 5, the shroud 120 is provided so as to correspond to the shape of a longitudinal section of the apparatus. More specifically, the shroud 120 is configured so as to fit within the longitudinal section of the apparatus.

A hermetic member 160 is further provided on an outer perimeter of the shroud 120 and contacts inner surfaces of the apparatus.

The hermetic member 160 may be configured as an elastic member such as a sponge or a rubber liner, although other sealing mechanisms are contemplated by the present invention.

The hermetic member 160, prevents air from passing through gaps between the outer perimeter of the shroud 120 and the inner surfaces of the machine room 10. Accordingly, air flows only through the opening 123, and thus the condenser 30 can dissipate heat more efficiently.

Additionally, vibration generated by the operation of the motor 130 and rotation of the fan 110 at the shroud 120 is prevented from being transmitted to the machine room 10.

The shroud 120 is coupled to the shroud coupling portion 142 such that the shroud 120 is spaced from the bottom surface of the machine room 10 by the hermetic member 160. In this regard, a portion of the hermetic member 160 extending along the outer perimeter of the shroud 120 is provided in the space between the shroud 120 and the bottom surface of the apparatus to prevent air from passing therethrough.

A fan assembly according to a second non-limiting embodiment of the present invention will now be explained in detail with reference to the attached drawings. Wherein the configuration and the description of the second non-limiting embodiment is the same as that of the first non-limiting embodiment, discussion of the same may be omitted (e.g. vibration preventing member 250 corresponds to the vibration preventing member 150 described and shown in the first non-limiting embodiment).

Figure 6:
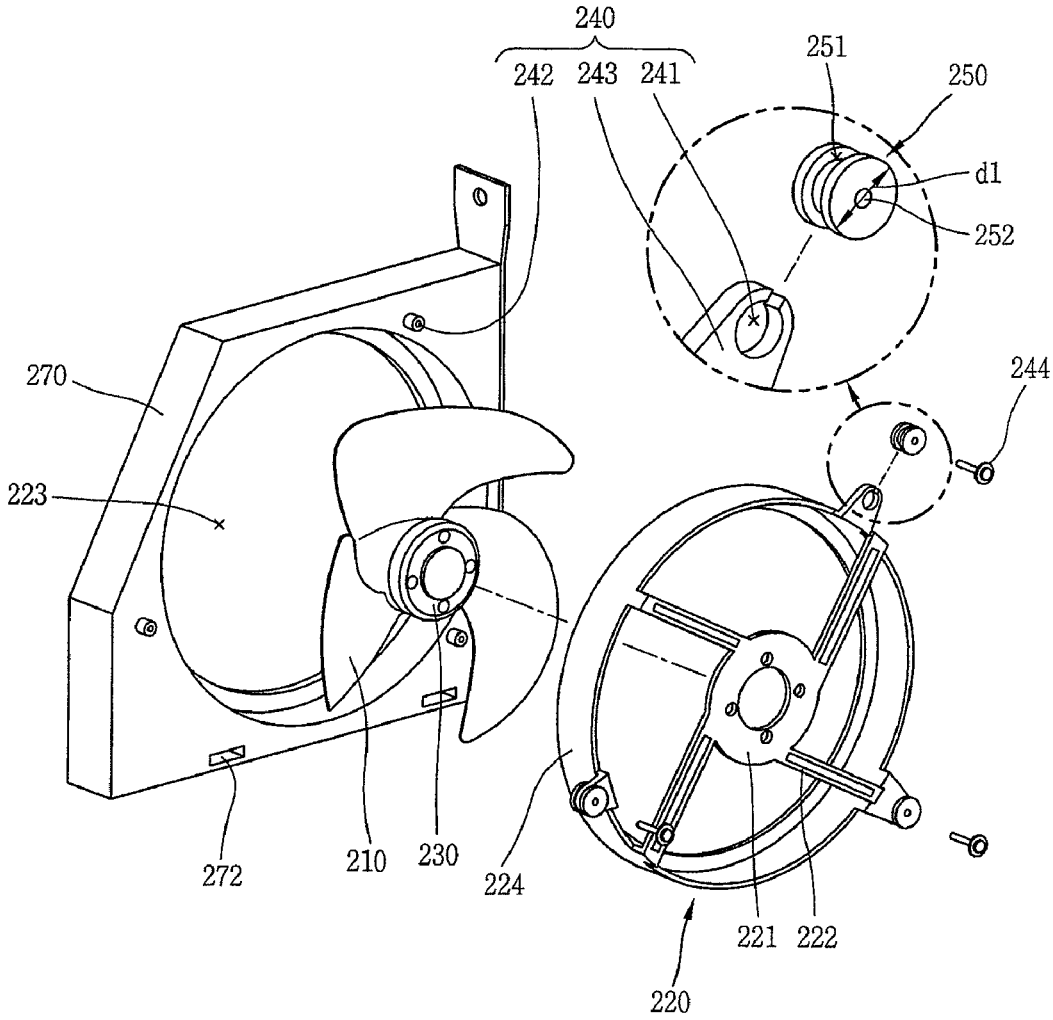
FIG. 6 is an exploded view of a frame, a shroud, and a fan according to another non-limiting embodiment of the present invention.
Figure 7:
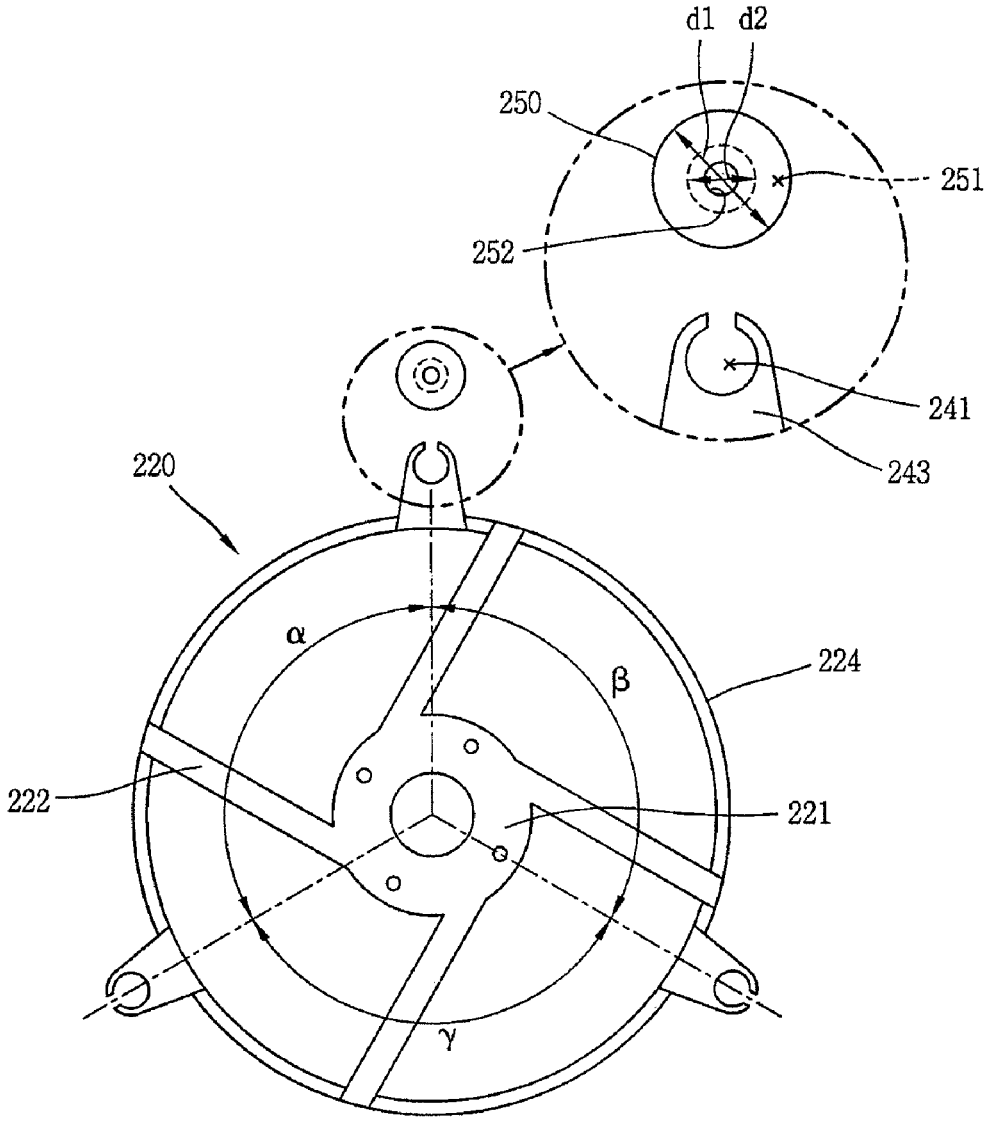
FIG. 7 is a rear side view of the shroud of FIG. 6.

More specifically, FIGS. 6 and 7 provide a fan that may be installed in an apparatus according to the second non-limiting embodiment of the present invention. FIG. 6 is an exploded view of a frame 270, a shroud 220, and a fan 210, and FIG. 7 is a rear view of the shroud of FIG. 6.

Referring to FIGS. 6 and 7, the fan 210 coupled to a motor 230 may be provided in the apparatus so as to dissipate heat from the compressor 40 and the condenser 30.

The motor 230 is mounted to a motor mounting portion 221 of the shroud 220, and the motor mounting portion 221 is connected to the shroud 220 by a plurality of motor supporting portions 222.

Accordingly, the motor 230 is mounted to and supported by the shroud 220.

The shroud 220 includes a shroud ring 224 and is disposed such that the shroud ring 224 is adjacent to an outer circumferential surface of the fan 210.

The shroud ring 224 is provided in a ring shape having a certain width in a radial direction of the fan 210 such that the flow of air generated by the fan 210 is guided therethrough.

The shroud ring 224 protrudes in an upstream direction of the fan 210, and is configured with a concave surface in a downstream direction of the fan 210.

Accordingly, air passing through the shroud ring 224 is prevented from leaking in a radial direction of the fan 210, and the amount of noise caused by air leakage can be reduced.

The shroud 220 is coupled to the frame 270 and the frame 270 is fixed to the apparatus surface via frame coupling portions 271.

The shroud 220 and the frame 270 are provided with coupling units 240 for coupling therebetween, respectively.

Vibration preventing members 250 configured to prevent vibration and noise (generated by the operation of the motor 230 and the rotation of the fan 210) from being transmitted to the apparatus through the frame 270 are interposed between the coupling units 240.

In order to allow air generated by the fan 210 to flow only through the shroud ring 224, the frame 270 is provided with an opening 223 corresponding to a diameter of the shroud ring 224. Here, the shroud ring 224 is accommodated in the opening 223.

In correspondence to the shape of the shroud ring 224, an end portion of the opening 223 protrude in the upstream direction of the fan 210, and has the concave surface in the downstream direction of the fan 210.

The coupling units 240 include protrusions 243 outwardly protruding from an outer circumference of the shroud ring 224 in a radial direction, receiving portions 241 having an arcuate surface are provided at the end of the protrusions 243 so as to be opened in the protruding direction, and shroud coupling portions 242 provided at the frame 270 in correspondence to the receiving portions 241.

In order to prevent the shroud 220 coupled to the frame 270 from moving, two protrusions 243 are provided; however, fewer or more protrusions are contemplated by the present invention.

The protrusions 243 are provided at an outer edge of the shroud ring 224 extending in the radial direction with a constant angle therebetween.

More specifically, as shown in FIG. 7, the protrusions 243 are provided so that angles therebetween of $\alpha$, $\beta$, and $\gamma$ can be equal to each other to uniformly distribute vibration generated by operation of the motor 230 and rotation of the fan 210.

Vibration preventing members 250 are received by the receiving portions 241 along the radial direction of the shroud ring 224, and are coupled to the frame 270 in a side direction via the shroud coupling portion 242.

The receiving portions 241 are provided such that each inlet width (W) thereof can be narrower than each outer diameter (d1) of the vibration preventing members 250 (having the same configuration as the vibration preventing members described in the first non-limiting embodiment).

Fitting grooves 251 fitted into the receiving portions 241 extend along the outer circumferential surfaces of the vibration preventing members 250. The fitting grooves 251 prevent the vibration preventing members 250 fitted into the receiving portions 241 from moving in a thickness direction (i.e., an axial direction).

Coupling holes 252 are provided through a central part of the vibration preventing members 250 in the thickness direction.

Coupling members 244 for coupling the shroud 220 and the frame 270 to each other are provided to penetrate the coupling holes 252. The coupling members 244 are coupled to the shroud coupling portions 242 provided on the rear surface of the frame 270 in correspondence to the protrusions 243.

Coupling of the frame 270 to the bottom surface of the machine room 10 will now be explained in detail with reference to FIGS. 8 and 9.

Figure 8:
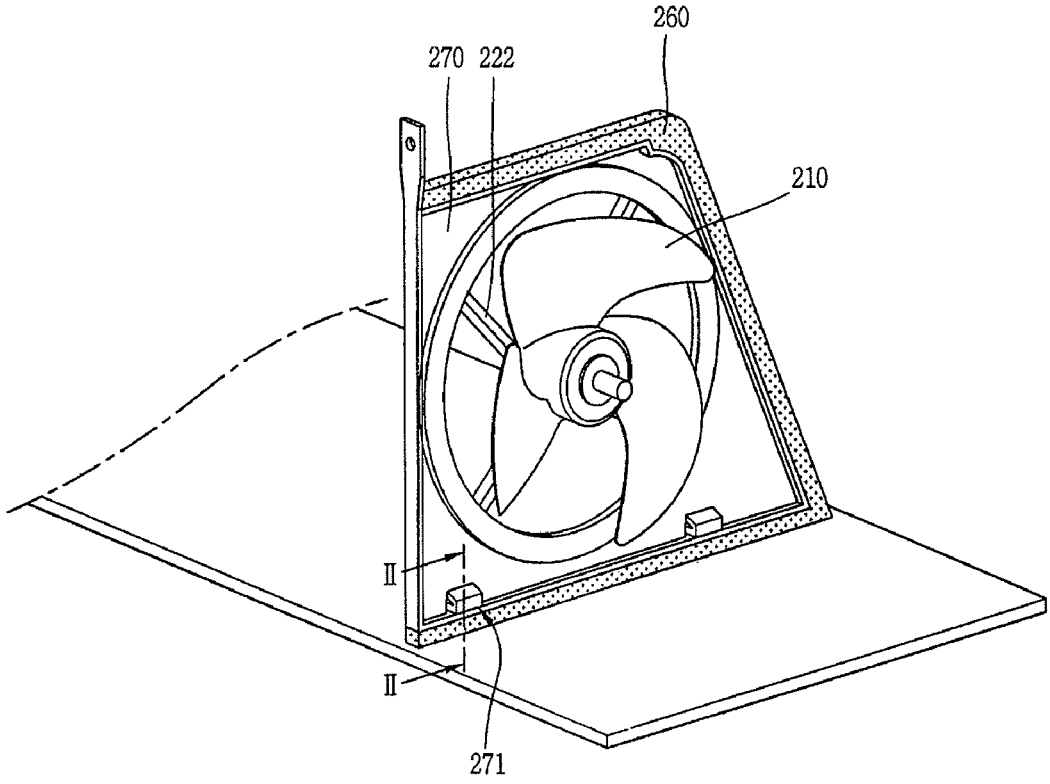
FIG. 8 is a perspective view of an alternative fan assembly according to yet another non-limiting, the fan assembly showing a frame fixed to a surface of an apparatus.
Figure 9:
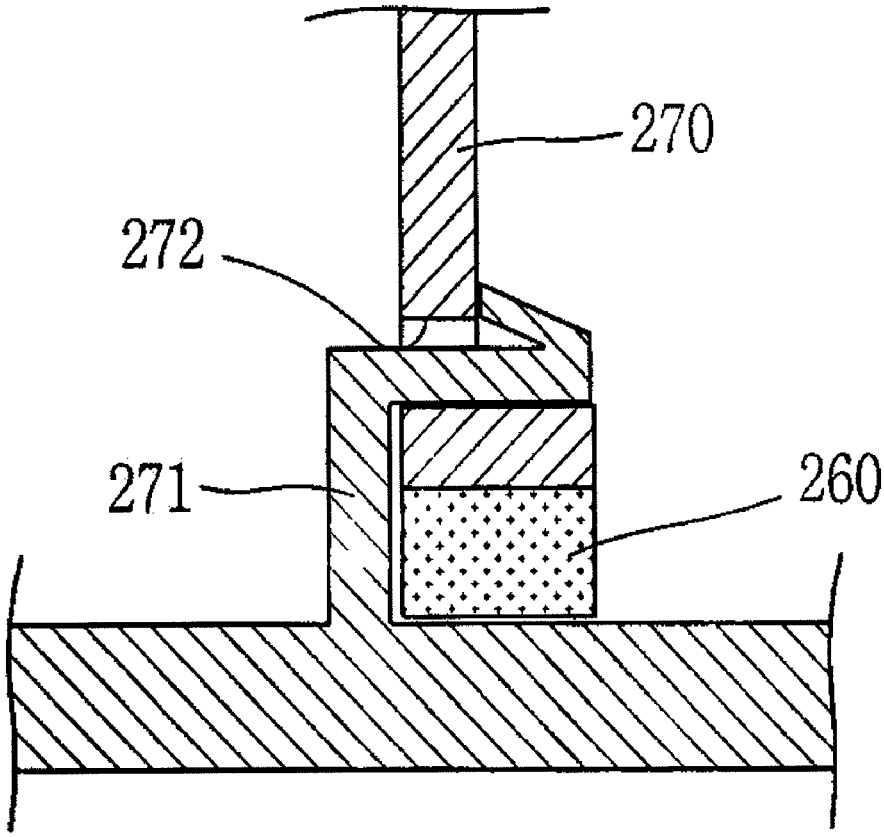
FIG. 9 is a sectional view taken along line 'II-II' in FIG. 8.

FIG. 8 is a view of a fan assembly according to another non-limiting embodiment of the present invention, showing that the frame is coupled to the apparatus, and FIG. 9 is a sectional view taken along line 'II-II' in FIG. 8.

Referring to FIGS. 8 and 9, the frame 270 is provided so as to correspond to a shape of a longitudinal section of the apparatus.

A hermetic member 260 is further provided on an outer perimeter of the frame 270 and contacts inner surfaces of the apparatus. The hermetic member may be made of a sponge or rubber liner, or any other suitable sealing material.

The hermetic member 260 prevents air from passing through gaps between the outer perimeter of the frame 270 and inner surfaces of the apparatus. Accordingly, air flows only through the shroud ring 224 accommodated in the opening 223, and thus the condenser 30 can dissipate heat more efficiently.

Additionally, vibration of the frame 270 that would otherwise be transmitted to the inner surfaces of the apparatus due to vibration of the motor 230 and fan 210 is prevented.

The frame 270 is fixedly coupled to frame coupling portions 271 provided on a bottom surface of the apparatus.

The frame coupling portions 271 protrude from a bottom surface of the apparatus. Insertion portions 272 configured to mate with the frame coupling portions 271 are provided at a lower side of the frame 270 parallel to the bottom surface of the apparatus. The frame coupling portions 271 further include a locking protrusion (that is also provided parallel to the bottom surface of the apparatus) that engages the insertion portions 272. The locking protrusion includes an elastically deformable locking arm that extends at an acute angle from an upper surface of the locking protrusion such that it may be inserted through the insertion portions 272. That is, when the frame coupling portions 271 are inserted through the insertion portions 272, the locking arm abuts a surface at the lower side of the frame 270 such that the frame coupling portion 271 cannot be easily disengaged from the frame 270.

The frame 270 may be integrally provided on a bottom surface of the apparatus. However, the former case is more preferable than the latter case in the aspect of assembly efficiency of the shroud 220 to the frame 270.

The number of the frame coupling portions 271 may be varied so that the frame 270 can be stably fixed to a bottom surface of the apparatus.

The fan assembly according to the first non-limiting embodiment of the present invention has the following advantages.

First, because the fan and the motor cause vibration and noise, because the fan and motor are mounted to the shroud, and because the shroud is fixed to the apparatus, the vibration preventing members are interposed between the coupling units of the shroud and the machine room. Therefore, the amount of vibration and noise transmitted from the fan and the motor to the apparatus can be reduced. That is, the vibration preventing members dampen (e.g., absorb) the vibration and reduce noise generation.

Second, since the hermetic member is provided on the outer perimeter surface of the shroud, air generated by the fan flows only through the opening of the shroud. Accordingly, effectiveness of heat dissipation from the condenser and the compressor is enhanced, and the amount of vibration and noise transmitted to the apparatus through the outer perimeter of the shroud can be reduced.

The fan assembly according to another aspect of the present invention has the following advantage.

Because the fan and the motor mounted to the shroud causes vibration and noise, because the shroud is coupled to the frame, and because the frame is fixed to the apparatus, the vibration preventing members are interposed between the shroud and the frame to reduce the amount of vibration and noise transmitted to the machine room from the fan and the motor.

The foregoing embodiments and advantages are merely exemplary and are not to be construed as limiting the present invention. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

Further, the illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The above disclosed subject matter is to be considered illustrative, and not restrictive, and the appended claims are intended to cover all such modifications, enhancements, and other embodiments which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

Although the invention has been described with reference to several exemplary embodiments, it is understood that the words that have been used are words of description and illustration, rather than words of limitation. As the present invention may be embodied in several forms without departing from the spirit or essential characteristics thereof, it should also be understood that the above-described embodiments are not limited by any of the details of the foregoing description, unless otherwise specified. Rather, the above-described embodiments should be construed broadly within the spirit and scope of the present invention as defined in the appended claims. Therefore, changes may be made within the metes and bounds of the appended claims, as presently stated and as amended, without departing from the scope and spirit of the invention in its aspects.

What is claimed is:

1. A fan assembly, comprising:

an axial fan;

a shroud comprising a motor mounting portion on which a fan motor of the fan is mounted;

one or more coupling units that couple the shroud to a planar surface of a machine room configured to receive a compressor and a condenser, wherein each of the one or more coupling units comprises:

a receiving portion formed as an opening at a lower end of the shroud; and a shroud coupling portion that protrudes upward from the planar surface of the machine room so as to be aligned with the receiving portion; and one or more vibration preventing members respectively interposed between the one or more coupling units and the shroud, wherein the receiving portion comprises a downwardly opened slot formed in a bottom edge of the shroud, wherein the receiving portion receives one of the one or more vibration preventing members therein, with the one of the one or more vibration preventing members positioned between the receiving portion and the shroud coupling portion.

2. The fan assembly of claim 1, wherein the one of the one or more vibration preventing members engages its respective receiving portion in a radial direction, and the one of the one or more vibration preventing members is coupled to its respective shroud coupling portion in an axial direction.

3. The fan assembly of claim 1, wherein an inlet width of the receiving is narrower than an outer diameter of its respective vibration preventing member.

4. The fan assembly of claim 1, wherein each of the one or more vibration preventing members comprises a fitting groove formed in an outer peripheral surface thereof that engages a corresponding inner peripheral surface of its respective receiving portion.

5. The fan assembly of claim 4, wherein the inner peripheral surface of the receiving portion comprises an arcuate surface having a radius of curvature that is less than half of an outer diameter of its respective vibration preventing member.

6. The fan assembly of claim 1, further comprising one or more coupling members that couple the one or more vibration preventing members to respective shroud coupling portions.

7. A fan assembly, comprising:

an axial fan;

a shroud, comprising:

a motor mounting portion on which a fan motor of the fan is mounted;

a shroud ring disposed around the fan; and a plurality of motor supporting portions extending radially outward from the motor mounting portion to the shroud ring;

a frame having the shroud mounted thereto, wherein the frame is coupled to a machine room of a refrigerator configured to receive a compressor and a condenser therein;

one or more coupling units that couple the shroud and the frame, each of the one or more coupling units comprising:

a protrusion extending radially outward from the shroud ring;

a receiving portion formed as an opening in the protrusion; and a shroud coupling portion provided on the frame so as to be aligned with the receiving portion; and one or more vibration preventing members respectively provided between the one or more coupling units and the frame.

8. The fan assembly of claim 7, wherein the frame comprises an opening that receives the shroud ring therein.

9. The fan assembly of claim 7, wherein each of the one or more vibration preventing members engage a respective receiving portion in a radial direction, and each of the one or more vibration preventing members is coupled to the frame in an axial direction.

10. The fan assembly of claim 9, wherein each of the one or more vibration preventing members comprises a fitting groove formed in an outer peripheral surface thereof that engages a corresponding inner peripheral surface of its respective receiving portion.

11. The fan assembly of claim 10, wherein the inner peripheral surface of the receiving portion comprises an arcuate surface having a radius of curvature that is less than half of an outer diameter of its respective vibration preventing member.

12. The fan assembly of claim 7, wherein the one or more coupling units comprises at least two coupling units provided around the shroud ring at uniformly spaced intervals.

13. The fan assembly of claim 7, wherein an inlet width of the receiving portion is narrower than an outer diameter of its respective vibration preventing member.

14. The fan assembly of claim 7, wherein a shape of the frame corresponds to a shape of a longitudinal cross section of the machine room, and wherein a hermetic seal is provided along an outer edge of the frame and maintains contact with a corresponding inner surface of the machine room.

15. The fan assembly of claim 7, wherein the frame is integrally provided with the machine room.

16. The fan assembly of claim 7, further comprising:

one or more frame coupling portions that protrude upward from a bottom surface of the machine room, each of the one or more frame coupling portions having an angled end portion; and one or more insertion portions formed in a lower end portion of the frame at positions corresponding to the one or more frame coupling portions such that the one or more frame coupling portions are respectively engaged in the one or more insertion portions to couple the frame to the bottom surface of the machine room.

17. The fan assembly of claim 16, wherein the angled end portion is elastically deformable.

* * * * *